United States Patent [19]

Widerby

[11] 4,109,564

[45] Aug. 29, 1978

[54] VENTILATION ELEMENT WITH TUBULAR CONNECTOR FOR INSERTION INTO AN OPENING IN A CEILING OR A WALL

[75] Inventor: Lennart Widerby, Jönköping, Sweden

[73] Assignee: AB Svenska Flaktfabriken, Nacka, Sweden

[21] Appl. No.: 755,049

[22] Filed: Dec. 28, 1976

Related U.S. Application Data

[63] Continuation-in-part of Ser. No. 741,681, Nov. 15, 1976, Pat. No. 4,078,476.

[30] Foreign Application Priority Data

Nov. 19, 1975 [DE] Fed. Rep. of Germany ... 7537113[U]

[51] Int. Cl.[2] ..... F24F 13/00

[52] U.S. Cl. ..... 98/40 N; 98/40 B; 248/27.3

[58] Field of Search ..... 98/40 N, 40 B, 114; 248/27.3, 56; 285/162, 319, 210

[56] References Cited

U.S. PATENT DOCUMENTS

| | | | |
|---|---|---|---|
| 2,983,535 | 5/1961 | Henning | 98/114 X |
| 3,063,356 | 11/1962 | Fitt | 98/40 B |
| 3,155,027 | 11/1964 | Dayus | 98/40 B |
| 3,205,809 | 9/1965 | Sweeney et al. | 98/40 B |
| 3,383,976 | 5/1968 | Schenkel | 85/80 |

*Primary Examiner*—William E. Wayner
*Assistant Examiner*—William E. Tapolcai, Jr.
*Attorney, Agent, or Firm*—Dorfman, Herrell and Skillman

[57] ABSTRACT

A ventilation element for mounting in a partition opening having a tubular connector having an open end for admitting air to a room, a cover for regulating the quantity and direction of incoming air, and a tubular diffuser which telescopically engages the connector and mounts the cover for adjustment toward and away from the open end of the connector. The diffuser has a cylindrial wall extending less than 360° to provide a radial inlet opening between the connector and the cover. The diffuser wall is engaged with the connector by fasteners and oblique slots which effect axial movement of the diffuser when it is rotated relative to the connector whereby the diffuser may be adjusted axially relative to the connector, and the connector and diffuser together may be adjusted circumferentially in the partition opening.

6 Claims, 4 Drawing Figures

VENTILATION ELEMENT WITH TUBULAR CONNECTOR FOR INSERTION INTO AN OPENING IN A CEILING OR A WALL

This application is a continuation-in-part of the earlier-filed application Ser. No. 741,681, filed Nov. 15, 1976, now U.S. Pat. No. 4,078,476.

The present invention relates to a ventilation element having a tubular connector for insertion into an opening in a ceiling partition or a wall partition.

An object of the invention is to further develop techniques for facilitating quick mounting and dismounting of such elements and for making secure and comfortable adjustments of such elements, e.g., an air intake valve, diffuser or the like.

These objects are achieved according to the present invention mainly by means of the characteristics stated in the claims.

Other features and advantages of the invention may be perceived from the following description with reference to the appended drawings, in which.

Figure 1:
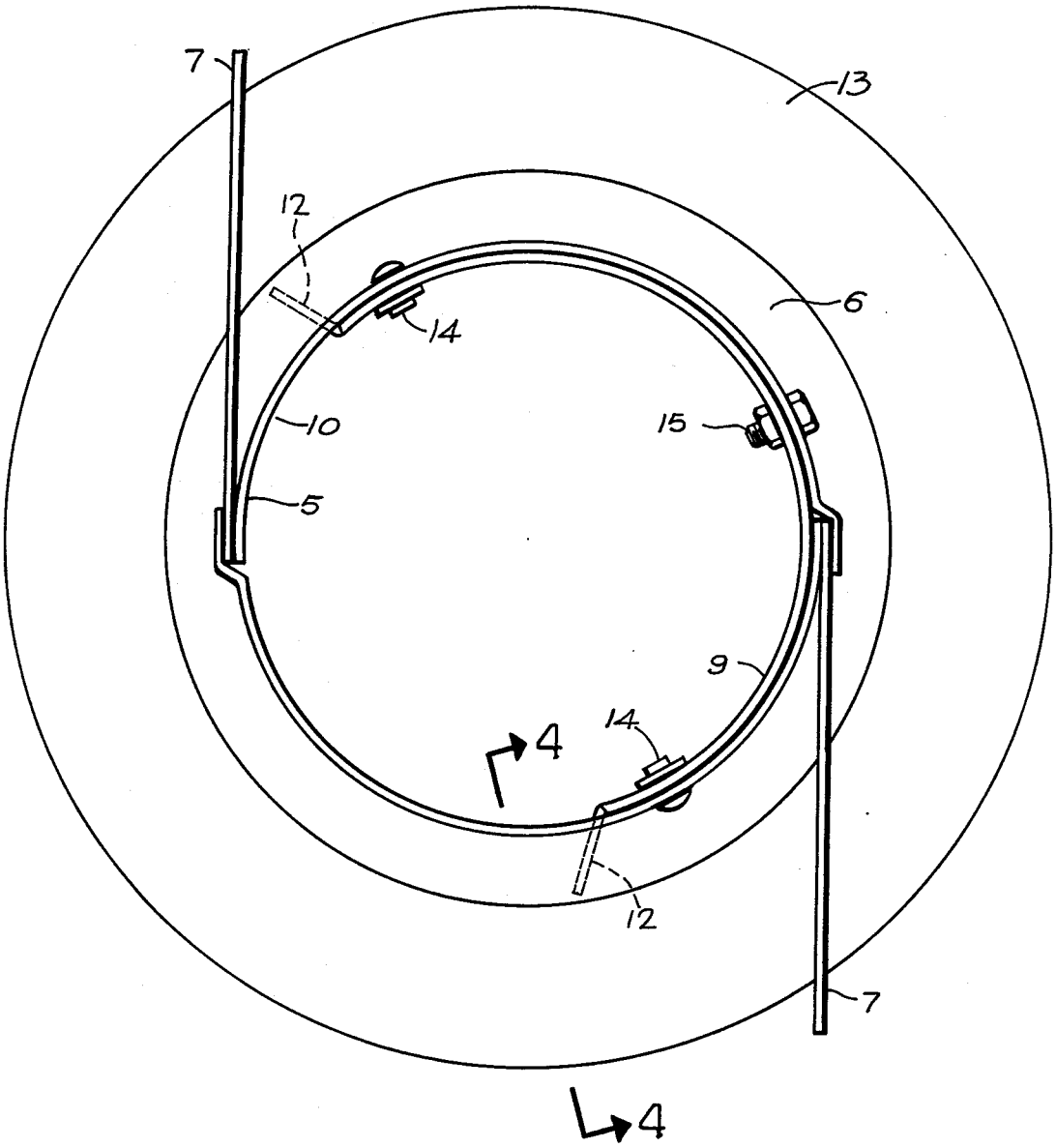
FIG. 1 shows an end view of a ventilation element according to the invention.
Figure 2:
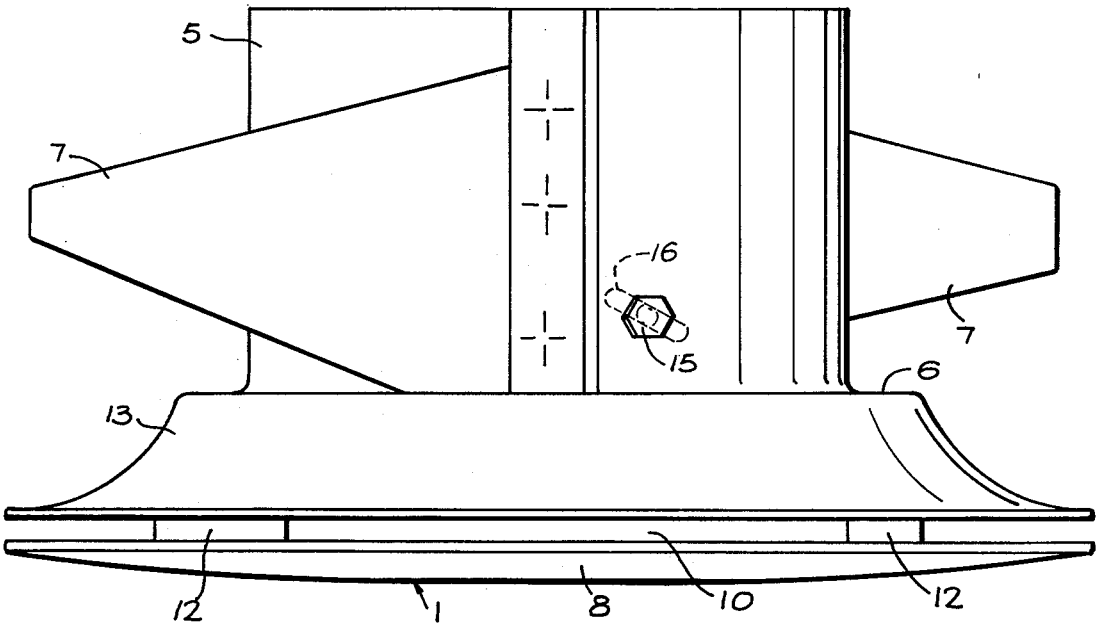
FIG. 2 shows the ventilation element of FIG. 1 in a side view.
Figure 4:
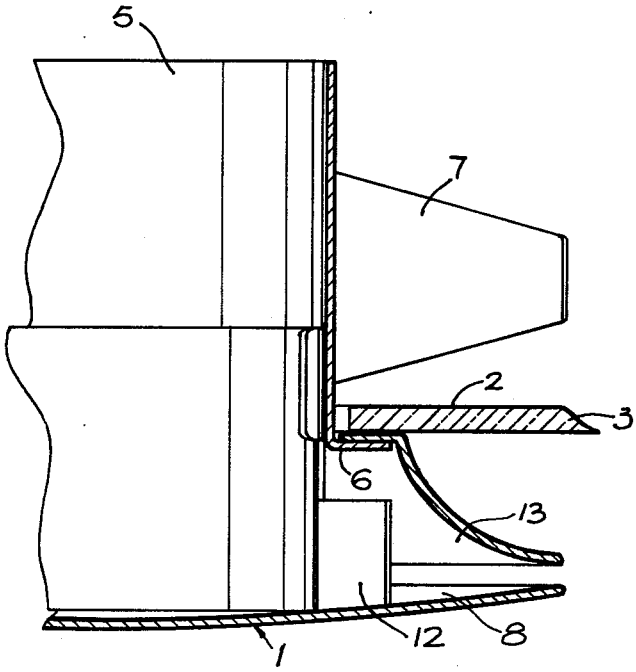
FIG. 4 is a fragmentary sectional view along the line IV—IV.

In the drawings, 1 reveals a ventilation element, which in principle can be anything having a connector 5 for inserting into an opening in a wall or ceiling partition. In the shown embodiment, the ventilation element 1 - combined with the outer or exposed part of the connector is a so-called diffuser, by means of which fresh air can be spread and/or directed for, as example, air conditioning.

Figure 3:
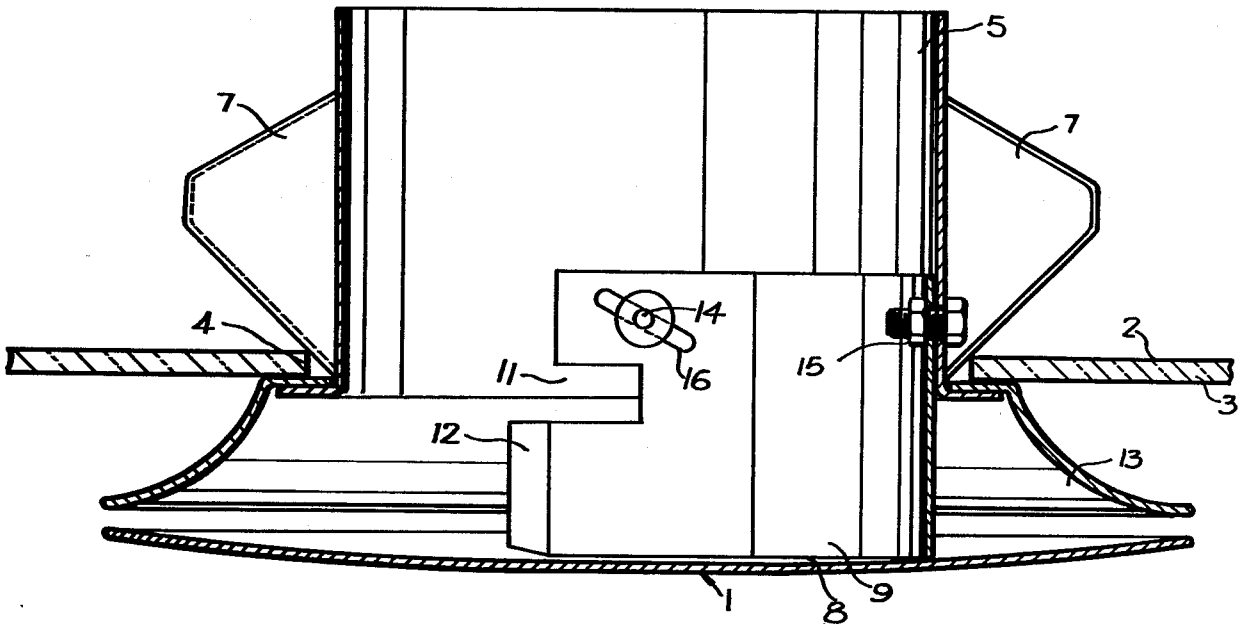
FIG. 3 shows the same element in another side view, partly in section.

Said ventilation element 1 comprises a flat, but somewhat convex cover disc 8 rigidly connected to a partly cylindrical insert 9, which is introduced telescopically in concentric relation to said connector 5. "Partly cylindrical" means in this case that a principally cylindrical pipe is cut off in axial direction to form an opening 10 in radial direction. As apparent from FIGS. 1 and 3, the width of that opening is somewhat differing in axial direction of said insert 9 in such a way that the free end of said insert in circumferential direction extends along e.g. 230°, meanwhile to said end is connected a recess 11 in circumferential direction extending along e.g. 190°. In the vicinity of said cover disc 8, said insert 9 can extend along e.g. 240° in circumferential direction and form lips 12, which are bent somewhat outwards and limit the lower part of said opening, which in radial direction goes free from said connector 5. Said lips 12 can optionally when the cover disc 8 reaches its furthest-inserted position about a flange or the like 6 extending from the end of said connector 5 adjacent said disc and forming stop means for limiting the insertion of the connector 5 into an opening 4 provided in a wall or ceiling partition 3. Said flange or the like 6 forms also the transition from a connector to a hood or the like 13 cooperating with the cover disc 8 and having about the same outline as the latter whereby they confront each other.

On its outside, the connector 5 is provided with e.g. two wings 7 arranged diametrically or at uniform circumferential distances in case of more than two wings. These wings 7 are of resilient material, as spring steel, and are preferably triangular. In accordance with a preferred embodiment both the upper and the lower longside are oblique, which means including an angle of less than 90° with said connector. This results in that advantage, that the connector 5 by means of a screwing movement can be inserted into an opening 4 in a wall or ceiling partition whereby said wings 7 are resiliently pushed towards said connector. The angle of said oblique wing edges with the connector can be between 60° and 45° in a practical embodiment.

The insert 9 and the connector 5 are interconnected by means of fasteners, e.g., rivets 14 and/or screws 15 with nuts, which preferably are arranged at 90° along the circumference of the furthest-introduced end of the insert 9. The fasteners pass through those parts, whereby in one of these parts, preferably in the insert 9, there are provided oblique slots 16, which are arranged at e.g. an angle of 60° in relation to the longitudinal axis of the connector 5. The effective extension of the slots 16 in axial direction of the connector corresponds to the desired change of the opening width between said hood 13 and said cover disc 8. All slots 16 are inclined in the same direction in circumference, which according to FIGS. 1 and 3, means towards the disc 8 in the same direction as the wings 8 extend from the connector. This brings along very special advantages of adjustment, which are to be explained as follows:

When the connector 5 with ventilation element is to be inserted in an opening 4, this can be done using only one hand of an operator. The only thing to do is to insert the free end of the connector 5 and then turn the disc 8 by means of the holding hand, from which disc the torsional moment is transferred to the connector 5 and the wings 7. Hereby the insert 9 is rotated somewhat in relation to the connector 5 until the rivets and/or the screw have obtained their upper end position in the grooves 16, but then an unreduced transfer of said torsional moment acts on the connector 5 and the wings 7, which are screwed into the opening 4 until the innermost oblique edges slide through the opening. After passing through the opening 4, the wings 7 spring out along the backside 2 of the wall or the like 3 containing the opening 4, whereby the wings 7 automatically will be stretched and lock the connector 5 with ventilation element in that opening. The partition 3 is pressed between the wings and the flange 6. In such a way a very quick and simple mounting of a ventilation element into a partition opening can be achieved and the size of the opening and the thickness of the partition can vary within wide limits.

If a pre-adjusted certain width of the opening between the hood 13 and the cover disc 8 of said ventilation element is desired, this has to be done before the above mentioned operation by tightening said screw 15 and thus determining that width. The screw 15 constitutes an adjustible fastener providing an interlock of the connector 5 and diffuser wall 9 at any selected position. But if the opening width between the hood 13 and the disc 8 has to be adjusted after insertion, then one only has to grip the disc 8, which reaches its nearest position towards the hood 13, and then the disc should be twisted anti-clockwise in the shown embodiment, so that the rivets 14 and screw 15 travel downwards in the slots 16 until the desired opening width has been achieved. The torsional moment hereby applied on the disc 8 will not be transferred to the connector 5, in which way said moment would be eliminated, because the torsional moment of said opening movement is directed towards or against the wings 7, because there are extending tangentially clockwise from a connector 5 and said opening movement is directed anti-clockwise as said before. The wings 7 will hereby come into a nipping or pinching engagement with the partition material surrounding said opening 4 and thereby arrest said connector, so that the connector cannot be twisted any longer in that direction.

When the width of the opening of the ventilation element again is to be diminished, it will be sufficient to push the disc in axial direction towards the hood 13, because the flange 6 acts as reliable stop means towards the wall or the like 3.

Thanks to the invention a connector with ventilation element simply and completely reliably can be mounted and dismounted entirely without tools and also an adjustment of the ventilation element can be achieved without any limitations.

At the same time there is still a possibility to remove the entire connector with ventilation without any tools, to what purpose one takes hold at the hood 13 with the disc 8 and twists those clockwise, whereby the oblique edges of the wings 7 near the hood slide out of the opening 4, whereupon the other oblique edges slide out in order to release the entire connector completely.

I claim:

1. A ventilation element for mounting into an opening in a partition characterized in that said ventilation element comprises a cylindrical connector having wings extending tangentially from its outside surface, and a diffuser having a cylindrical wall telescopically introduced into said connector and interconnected by means of fasteners which are guided in oblique slots in one of said telescoping parts, said slots being inclined towards the zone of introduction in the same circumferential direction as said wings, the cylindrical wall of the diffuser being cut off in axial direction to form a radial opening and being rigidly connected to a cover disc to form a barrier against the radial flow of air beyond said radial opening.

2. An element according to claim 1 wherein the cylindrical wall near said disc has outwardly extending lips limiting said radial opening and acting as stop means engaging said connector, to limit closing movement of said cover disc.

3. An element according to claim 2 characterized in that the opening width of said diffuser wall differs in axial direction such that the furthest-inserted inner end of the wall in circumferential direction extends along a greater sector than a middle part, said lips being formed by the free ends of an outer part of said wall extending along a greater sector than said inner end part.

4. A ventilation element for mounting into an opening in a partition characterized in that said ventilation element comprises a cylindrical connector having stop means for engaging one surface of the partition for limiting axial displacement of said connector through said opening, and flexible wings extending tangentially from its outside surface, said wings having an inclined surface facing said stop means at an angle less than 90° with the axial length of the connector for engaging the opposite surface of the partition affording rotation of said connector in one direction about its axis and resisting rotation of said connector in the opposite direction, and a diffuser having a cylindrical wall telescopically introduced into said connector and interconnected by means of fasteners which are slidable and guided in oblique slots in one of said telescoping parts, said slots being inclined towards the zone of introduction in the same circumferential direction as said wings, whereby rotation of the diffuser in said one direction may rotate the connector, and rotation of the diffuser in said opposite direction affords adjustment of the diffuser axially relative to the connector.

5. An element according to claim 4 wherein both longitudinal edges of the wings constitute inclined surfaces which converge in the direction extending from the outside surface of said connector.

6. An element according to claim 4 wherein the slidable fasteners are two diametrically arranged rivets and including, in addition, an adjustable fastener to interlock the connector and the diffuser selectively against said relative axial adjustment.

* * * * *